United States Patent [19]

Greenwood et al.

[11] Patent Number: 4,563,050

[45] Date of Patent: Jan. 7, 1986

[54] DEVICE FOR FLAT MULTICONDUCTOR CABLE CONNECTION

[75] Inventors: William S. Greenwood, Nutley; Karl Weinmann, Watchung, both of N.J.

[73] Assignee: Thomas & Betts Corporation, Raritan, N.J.

[21] Appl. No.: 630,794

[22] Filed: Jul. 13, 1984

[51] Int. Cl.[4] ..... H01R 9/07; H01R 29/00

[52] U.S. Cl. ..... 339/99 R; 339/31 R

[58] Field of Search ..... 339/17 F, 97–99, 339/176 MF, 31 R, 31 M

[56] References Cited

U.S. PATENT DOCUMENTS

| | | | |
|---|---|---|---|
| 2,964,587 | 12/1960 | Minot | 174/117 |
| 3,143,214 | 8/1964 | Moore et al. | 211/26 |
| 3,189,863 | 6/1965 | Leach | 339/176 MF |
| 3,281,762 | 10/1966 | Jones | 339/198 |
| 3,355,699 | 11/1967 | Oshva | 339/99 |
| 3,496,518 | 2/1970 | Neumann et al. | 339/21 |
| 3,816,818 | 6/1974 | Meier | 339/99 |
| 3,818,415 | 6/1974 | Evans et al. | 339/17 |
| 3,832,503 | 8/1974 | Crane | 200/51 |
| 3,864,011 | 2/1975 | Huber | 339/103 |
| 3,907,396 | 9/1975 | Huber | 339/103 |
| 4,181,388 | 1/1980 | Donato | 339/21 |
| 4,219,928 | 9/1980 | Kuo | 29/868 |
| 4,240,687 | 12/1980 | Bonnell et al. | 339/99 |
| 4,240,688 | 12/1980 | Sotolongo | 339/122 |
| 4,289,370 | 9/1981 | Storck | 339/125 |
| 4,351,579 | 9/1982 | Kordes et al. | 339/14 |
| 4,480,889 | 11/1984 | Greenwood | 339/99 R |

FOREIGN PATENT DOCUMENTS

| | | | |
|---|---|---|---|
| 2031215 | 3/1974 | Fed. Rep. of Germany | 339/98 |
| 2254395 | 5/1974 | Fed. Rep. of Germany . | |

OTHER PUBLICATIONS

AMP Inc., instruction sheet IS3131, 10-17-83, "Undercarpet Power Cabling System", pp. 1-2.

*Primary Examiner*—Neil Abrams

*Attorney, Agent, or Firm*—Robert M. Rodrick; Salvatore J. Abbruzzese

[57] ABSTRACT

An electrical connection adapter device is provided for making electrical connection between multiconductor plural-phase (4 or 5 conductor) cable and multiconductor single-phase cable (3 conductor). The adapter device includes an insulative member that has opposing sides adapted to be placed in juxtaposition with two cables to be interconnected. The insulative member supports a first set of insulation piercing contact elements in a fixed disposition at one side and a second set of insulation piercing contact elements on the other side. The first set of contact elements are adapted to be placed in registry with individual conductors of a first cable, such as the 3 conductor cable. The second set of contact elements are respectively conductively interconnected to the first set of contact elements and are movable relative to each other, such that at least one of the contact elements of the second set is selectively registrable with plural conductors of a second cable, such as a 4 or 5 conductor cable.

22 Claims, 7 Drawing Figures

DEVICE FOR FLAT MULTICONDUCTOR CABLE CONNECTION

FIELD OF THE INVENTION

The present invention relates generally to multiconductor flat cable systems and pertains more particularly to a device for use in making a selective single-phase electrical connection to flat conductor plural-phase cable.

BACKGROUND OF THE INVENTION

Flat conductor cable (FCC) underlying carpet tiles is in present use to supply electrical power to various points of use, as for example, handling lighting and appliance loads in commercial buildings. The flat conductor cable includes in a common form thereof a plurality of flat conductors i.e., live, neutral and ground conductors encased in a plastic electrically insulative casing and additionally having a metallic shield disposed at the upper surface of the cable. A layer typically made of tough insulation material may be provided on the bottom of the cable as an abrasion protection shield. The metallic shield is electrically grounded to provide against electrical hazard, such as accidental piercing of the shield and the live conductor by an object, which object, since the shield is connected to ground, is rendered unhazardous to a person who might contact same. An advantage of the use of this type of conductor cable is the ease with which it can be installed beneath carpeting while at the same time allowing for transfer of power therefrom at selected locations, pedestals or transfer receptacles being installed for such purpose.

Various specialized types of devices including receptacles are known for establishing power take-off from the flat conductor cable at a given location as well as for effecting splicing of a branch line to a main. Thus, for connecting a receptacle at a desired location, a terminal block carrying insulation-piercing members or contacts can be secured over the flat conductor cable with the contacts piercing the flat conductor cable to establish continuity with the respective cable conductors. A receptacle can then be placed over the terminal block with suitable connection between the terminals of the block and contact points in the receptacle being made with round wire discrete conductors. With such installation the cable run can be terminated at the take-off location or it may pass through the terminal block so that additional receptacles can be connected further down the line.

It is also known to use, for purposes of providing power take-off, a receptacle which embodies insulation-piercing contacts therein and employed when installed directly over a conductor cable to have these piercing contacts electrically connectively engage the conductors in the cable. Such a receptacle is shown in commonly-assigned U.S. Pat. No. 4,479,692, issued on Oct. 30, 1984 and entitled "Receptacle for Flat Multi-Conductor Cable".

In U.S. Pat. No. 4,480,889 also commonly-assigned herewith, issued on Nov. 6, 1984 and entitled "Apparatus and Method for Tapping or Splicing Flat Multiconductor Cable", a technique and simplified device are disclosed which allow a tap or splice to be made at the same location where a flat conductor cable receptacle is present, i.e., directly under the receptacle. The device comprises a relatively elongated, thin holder of electrically insulative material having marginal configuration like that of the above-mentioned receptacle, the holder carrying insulation-piercing type contacts so arranged in such positioning, e.g., corresponding to the live, neutral and ground contact means in the receptacle, as to superpose the live, neutral and ground conductors in the branch cable when placed over the main cable during the splice installation. The insulation-piercing teeth of the respective contacts in the holder are located at both the bottom and top sides of the holder and the overall thickness of the contacts is greater than that of the holder. The holder is also provided with features such as notches and a telltale which must be properly registered with companion structure on the support member and the overlying receptacle in order to effect proper installation and orientation of the device in the intended manner. To make a splice connection, a support member is placed under the main or primary three-conductor flat cable at the location from which the splice is to be taken, the shield at the top side of the main cable is removed from over the live and neutral conductors of the cable and the holder device then placed on top of the main cable with the live, neutral and ground contacts therein in registry with the associated cable conductors. The branch, or secondary cable to be spliced to the main cable, is then superposed over the main cable, i.e., with its conductors in longitudinal registry with those in the main.

A receptacle, e.g., of the type described in U.S. Pat. No. 4,479,692 above noted, is then received on top of the branch cable and fastened with screws to the support member. Such fastening will result in the cable piercing contact portions at the bottom and top of the holder device piercing respectively, the insulation and conductors of the main cable from the top side thereof and the insulation and conductors of the branch cable from the bottom side thereof. The fastening also will result in the insulation-piercing by the receptacle contacts of the insulation of the branch conductors and coming into contact with such conductors. The run of the branch cable can then be carried out in any intended direction with the branch cable being first folded in the manner taught in U.S. Pat. No. 4,219,928 to provide that the protective shield of the branch cable is disposed at the top side of the branch.

Despite the advantages provided the flat cable system planner and installer in the foregoing developments, a difficulty which, however, remains is the efficient accomodation of the several different cable runs which are present in typical installations. Generally, the main flat cable and the primary building feeder involve a three-phase interface, i.e., the initial flat cable run is of five-conductor variety. Taps and splices to this primary flat cable are typically of single-phase (three conductor) for powering of receptacles. The taps and splices must collectively achieve a high degree of phase-balancing, whereby the respective A, B and C phases of the primary feeder are loaded to within a given percent of one another. Accordingly, the typical installation involves single-phase taps and splices to each of the three phases at hand, which taps and splices locations do not have receptacles thereat. The receptacle devices above discussed are thus operative only upon three conductor cable.

SUMMARY OF THE INVENTION

The present invention has as its overall object the provision of apparatus and method for rendering more efficient the three-phase flat conductor cable installation.

A more particular object of the present invention is to provide connection devices which extend the above-discussed advantages in three-phase flat cable installations to accomodate ready transition from three-phase cable to single-phase pedestals.

In achieving the foregoing and other objects, the invention provides an electrical connection device for use in interconnecting one (a first) insulated flat conductor cable having a given number of conductors with another (a second) insulated flat conductor cable having conductors in number greater than said given number. In its preferred form, such device comprises a contact support member having first and second opposite sides respectively for juxtaposition with the first and second cables. First and second sets of insulation-piercing contact elements are provided and are individually interconnected to one another. The support member supports the first set of contact elements in fixed disposition at its first side for registry with individual conductors of such one cable and supports the second set of contact elements at the second side thereof for selective registration with different groups of conductors of the second cable in such given number. The support member preferably supports at least one of the contact elements of the second set for movement therein into registration with different conductors of the second cable. A power take-off unit, typically in the form of a pedestal having insulation-piercing contacts, of type above discussed, can be applied to the device in confronting relation with the other side of the first cable, thus to provide single-phase power at the connection location.

The above and other objects and features of the invention will be further understood from the following detailed description of preferred embodiments and from the drawings wherein like features are identified by like reference numerals throughout.

DESCRIPTION OF THE PREFERRED EMBODIMENT

Figure 1:
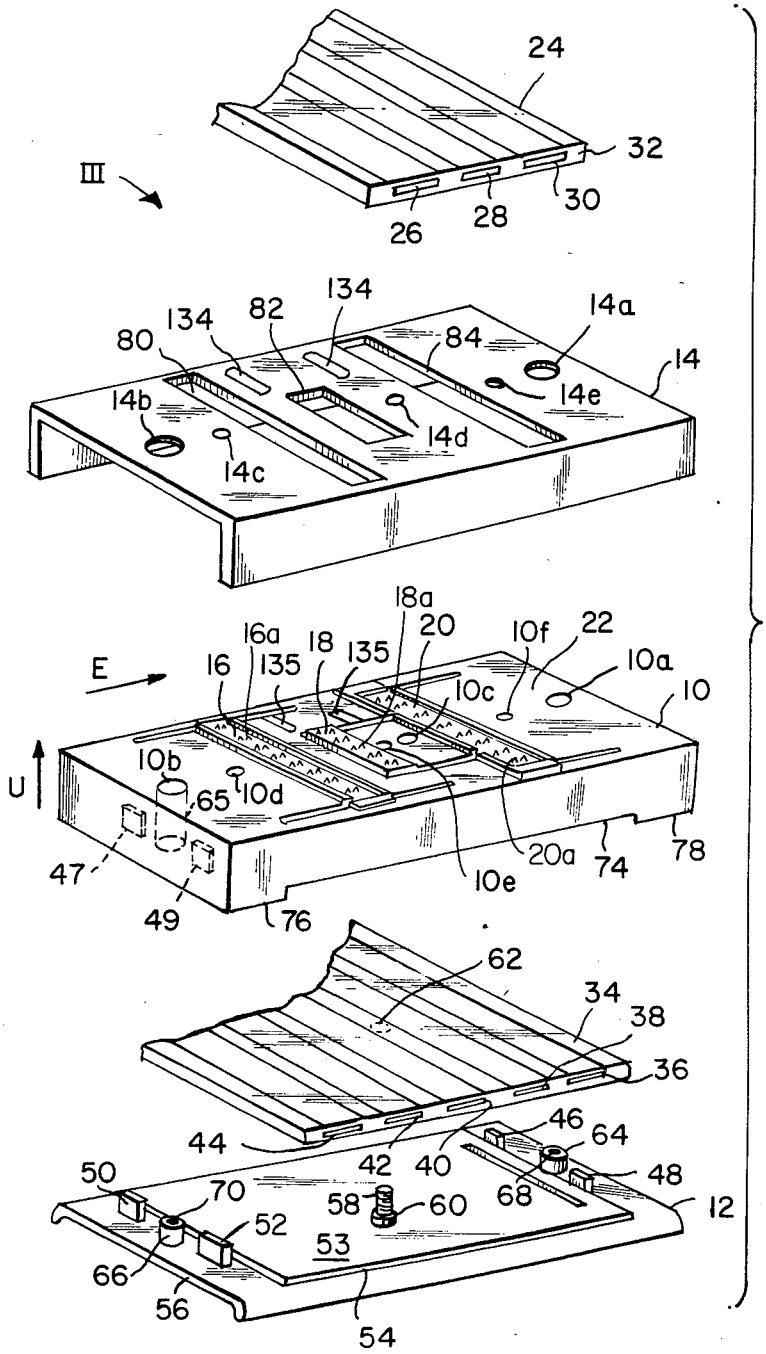
FIG. 1 is an exploded perspective view of a connecting device in accordance with the invention, shown also with multiconductor cables having respective different numbers of conductors.

Referring to FIG. 1, a connecting device in accordance with the invention is shown, including contact support member 10, base 12 and cover 14. Support member 10 is formed of a suitable insulative material and is generally of rectangular configuration, being elongate in direction E and upstanding in direction U. A first contact element set comprising contact elements 16, 18 and 20 is disposed in fixed positional manner on first surface 22 of support member 10, for confronting a three conductor cable 24. Cable 24 includes flat conductors 26, 28 and 30 disposed in insulative casing 32. For reference purposes, and by way of accepted industry convention, conductor 30 is an electrical neutral conductor and casing 32 includes a white coloration to identify this conductor. Conductor 28 is the ground conductor and casing 32 includes a green coloration overlying same. Conductor 26 is a live (single-phase) conductor and may bear overlying casing indication in the colors black, red or blue. Contact elements 16, 18 and 20 are of insulation-piercing type including conventional insulation-piercing elements **16*a*, 18*a* and 20*a* and will respectively engage electrically conductors 26, 28 and 30** upon assembly.

A second contact element set is included in support member 10, to be discussed more particularly below in connection with FIG. 2, and is disposed at the underside of support member 10 for insulation-piercing engagement with conductors of a cable 34. Cable 34 is shown to be of five conductor (three-phase) type having neutral conductor 36, ground conductor 38 and individual phase conductors 40, 42 and 44 (A, B and C phases). The conductors of cable 34 are also typically color-coded.

Base 12 includes cable guides 46–52 aside cable receipt expanse 53 which is defined by an insulative layer 54 disposed atop metal substrate 56. Securing means 58 is preferably integral with substrate 56 and is in the form of a threaded member having an annular insulator 60 adjacent insulative layer 54. The positioning of threaded means 58 in relation to guides 46–52 is such that, upon placement of cable 34 upon base 12, means 58 passes through cable 34 at location 62, i.e., through the insulation between conductors 38 and 40, at which time annular insulator 60 is resident in cable 34, precluding electrical continuity, through means 58, between conductors 38 and 40. It should be noted that with four-conductor cable, for example, such positioning of threaded means 58 through the cable can be assured by using the neutral conductor 36 as a reference and placing the adjacent edge of the cable into engagement wih base guides 46–48. Upstanding posts or projections 64 and 66 will, upon assembly of member 10 with base 12, nest in underside recesses in member 10 one such recess being shown at 65. Guides 46–52 in combination with support member tabs 47 and 49 will provide an anti-bowing or anti-deflection capability for base 12 and cable 34 seated thereon. Posts 64 and 66 include threaded central openings 68 and 70, respectively, for assembly purposes. A white indicium 72 is applied to insulative layer 54 to indicate to the user the proper polarization of cable 34 with respect to base 12, namely, that white (neutral) conductor 36 should overly indicium 72.

As will be seen, support member 10 includes a central lower indentation 74 through which cable 34 will extend upon assembly. Legs 76 and 78 of member 10 will abut the upper surface of base 12 on assembly. Cover 14 is dimensioned to fit telescopically over support member 10 on assembly and includes upper surface openings 80, 82 and 84, through which contacts 16, 18 and 20 respectively extend to engage cable 24 when the latter is applied to the upper surface of cover 14. In assembly, openings **14*a* and 10*a* are aligned, as are openings 14*b*** and 10*b* to permit threading of screws into posts 64 and 66. A nut is applied in opening 10*c* to securing means 58.

Figure 2:
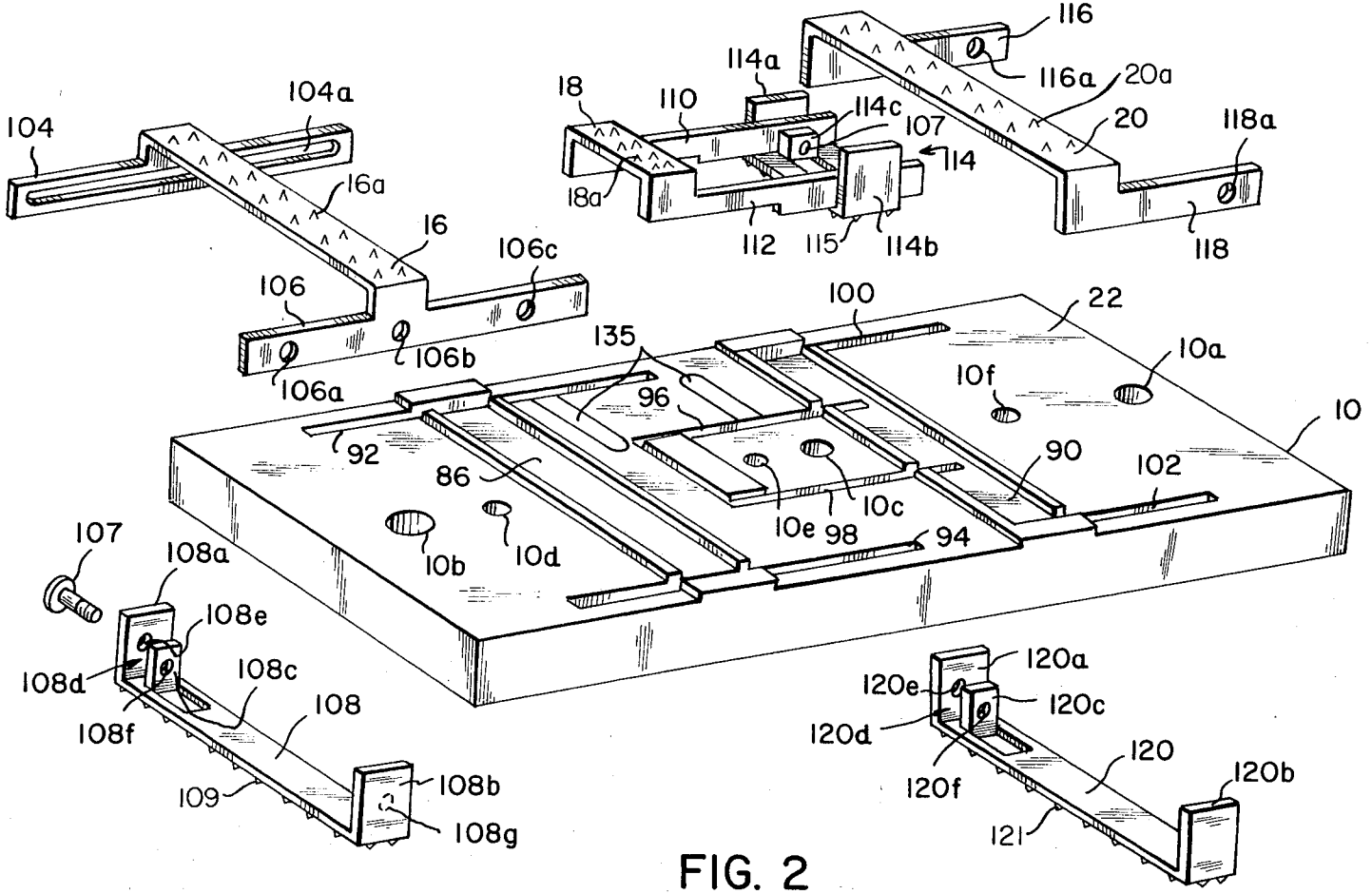
FIG. 2 is an exploded perspective view of the contact support member of FIG. 1 and the contact element sets supported thereby.

Referring to FIG. 2, wherein the contact elements are shown in exploded manner relative to support member 10, it will be seen that upper surface 22 includes contact seats 86, 88 and 90, the perimeters of which extend upwardly from surface 22 in measure equal to the depth of cover 14 adjacent openings 80–84 of FIG. 1. Elongate channels 92 and 94 extend in both directions from contact seat 86. Channels 96 and 98 extend rightwardly of contact seat 88 and into contact seat 90. Channels 100 and 102 extend rightwardly of contact seat 90.

Contact element 16 has flanges 104 and 106 integral therewith and serving as conductive means for electrically connecting contact element 16 with its counterpart contact element 108 of the second set of contacts referred to above. As will be discussed further below, contact element 108 includes conventional insulation-piercing elements 109 projecting from its undersurface and is supported in flanges 104 and 106 for translatory movement in support member 10. Contact element 18 includes flanges 110 and 112, again integral therewith, and serving as conductive means for interconnecting contact element 18 with its counterpart contact element 114 of the second set. Conventional insulator-piercing elements 115 project from the undersurface of contact element 114. Contact element 20 has integral flanges 116 and 118 serving as conductive means for connecting same with its counterpart contact element 120 of the second set. Conventional insulation-piercing elements 121 project from the undersurface of contact element 120.

Contact element 16 includes in flange 104 a track 104*a* to support contact element 108 for translation into any selective one of three positions. For defining such positions, flange 106 includes detents in the form of through openings 106*a*, 106*b*, and 106*c*. Contact 108 includes end flanges 108*a* and 108*b*, which are respectively exteriorly aside flanges 104 and 106 upon assembly of contact elements 16 and 108. Wall 108*c* is struck upwardly from the floor of contact element 108 to provide a channel 108*d*, in which flange 104 resides. A threaded member 107 passes through opening 108*e*, through track 104*a* and is threaded into opening 108*f* to secure the assembly. Boss 108*g* is situated on the interior side of flange 108*b* and is sized to removably reside in any of openings 106*a*, 106*b* or 106*c* to effect the proper positioning of contact element 108.

An assembly of a first set contact element and a second set contact element is shown in FIG. 2 in the case of contact element 18 and its counterpart second set contact element 114 in FIG. 2 with parts being identified in a manner similar to those designated for contact elements 16 and 108.

In assembling support member 10 and its first and second set contact elements, the first set contact elements are first inserted as follows. Flanges 104 and 106 are disposed in channels 92 and 94, whereby contact element 16 resides on seat 86. Flanges 110 and 112 are disposed in channels 96 and 98, whereby contact element 18 resides on seat 88. Flanges 116 and 118 are disposed in channels 100 and 102, whereby contact element 20 resides on seat 90, being spaced by member 10 above flanges 110 and 112, which are stepped down as indicated. Next, contact elements 114 and 120 are inserted into the underside of member 10 and secured respectively to flanges 110, 112 and 116, 118. Selection is made for the state of contact element 108 and it is inserted into the underside of member 10, translated into selected position and secured in place. The showing of member 10 in FIG. 1 is thus reached.

Figure 3:
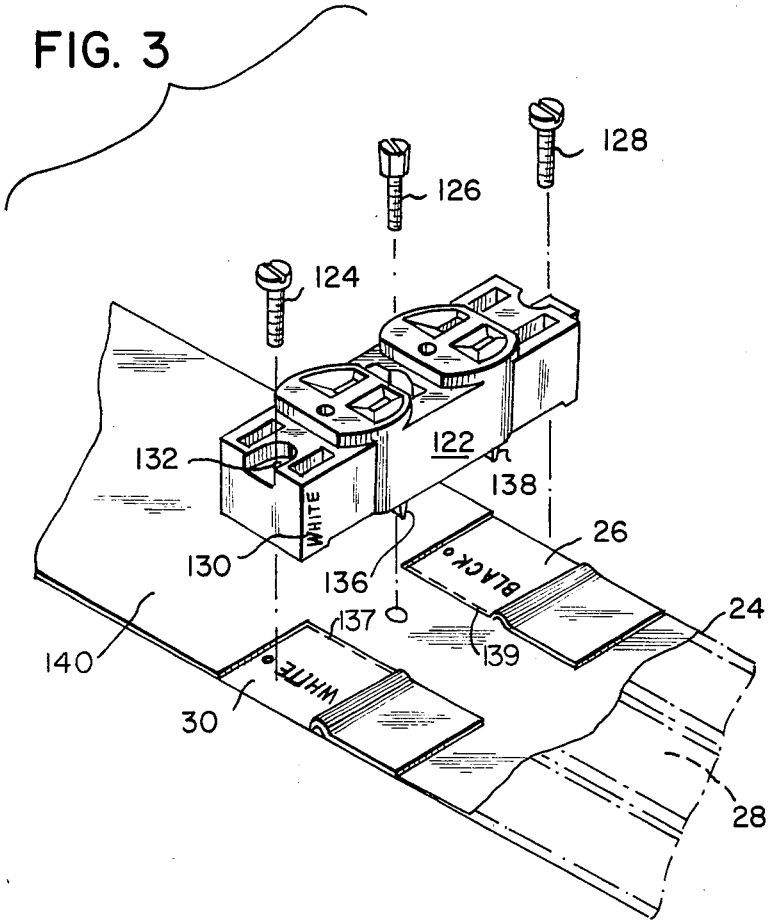
FIG. 3 is a partial perspective and exploded view, as seen in direction III of FIG. 1, of a power outlet for aa three-conductor cable, shown here with overlying shield.

Referring to FIG. 3, the assembly of components above discussed is expanded to include receptacle 122 and the respective and fastener screws 124, 128 and a grounding fastener screw 126. The receptacle 122 carries indicia as at 130 which are cooperative with the indicia on the cable indicative of proper receptacle orientation to insure correct polarity of electrical connections to be made. Further in this regard and to insure proper placement orientation of the receptacle on the cable, the receptacle has screw-through passages which function as a telltale cooperative with cover openings 14*c–e* and support member openings 10*d–f* (FIG. 1) when correct receptacle placement is effected to indicate such condition. Another safeguard that insures that proper orientation must be employed to install the receptacle is provided by tabs 136, 138 at the underside of the receptacle which must pass through cable 24 at perforations 137, 139 between the ground conductor and the live and neutral conductors and be received in openings 134, 135 of cover 14 and support member 10, respectively, in order for the receptacle to seat properly. If reciprocal orientation were attempted, the tabs would not line up with openings 134, 135 and hence not pass therethrough preventing proper seating.

Figure 4:
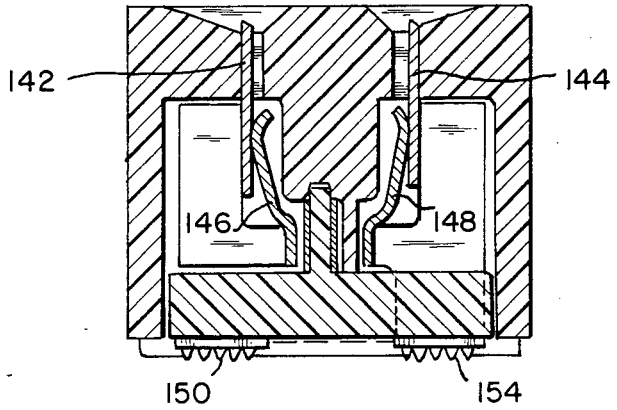
FIG. 4 is a typical sectional view of the FIG. 3 receptacle with appliance plug prongs in place.

The protective metallic or grounding shield 140 on top of cable 24 will, as a preliminary to connecting the receptacle thereto, be removed or cut and laid back in the rectangular pattern as shown in regions overlying the live and neutral conductors 26 and 30 of the cable leaving exposed the insulative covering in which said conductors are encased. The shield may be cut and laid back by folding same rightwardly on top of uncut portions of the shield since this facilitates effecting repair to the shield in the event the receptacle is removed. Like cable preparation is made for cable 34 of FIG. 1. It should be appreciated, however, that the cable may be prepared by full displacement of the cable shield so as to expose the entire upper surface thereof for insulation-piercing connection to the receptacle. More specific understanding of the receptacle will be had by consideration of U.S. Pat. No. 4,479,692 identified hereinabove and hereby incorporated by reference. In particular, FIGS. 2–5 of such patent show the contact elements thereof as having first end portions for engaging the appliance prong terminals and second end portions for insulation piercing the cable. For immediate reference purposes, FIG. 4 hereof shows a typical section of the pedestal with appliance prongs shown at 142, 144, with contact element first portions at 146, 148 and with second end portions 150, 154.

Figure 5:
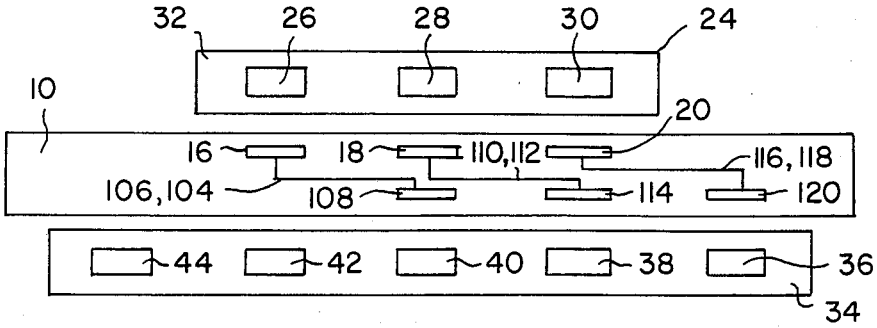
FIGS. 5, 6 and 7 are schematic views showing respective different phase connections made between the cables of FIG. 1 through use of the FIG. 1 device in its several states.

Referring to FIG. 5, contact support member 10 is shown schematically in first operative state between cables 24 and 34, as it would be upon securement of the FIG. 3 pedestal to the FIG. 1 connection device with the cables in indicated position. As will be seen, cable 24 is laterally centered with respect to support member 10, as is also the case for cable 34. Although neutral conductor 30 laterally overlies ground conductor 38, the support member effects a lateral connection transition or offsetting of one conductor step, whereby conductor 30 is connectable to its counterpart neutral conductor 36, flanges 116 and 118 effecting such transition between first set contact element 20 and second set contact element 120.

A like one step transition is also fixedly provided as between ground conductors 28 and 38 through flanges 110 and 112 interconnecting first set contact element 18 and second set counterpart element 114.

In the FIG. 5 setting of support member 10, a further one step transition rightwardly is also provided as between phase conductors 26 and 40 through flanges 104 and 106.

Figure 6:
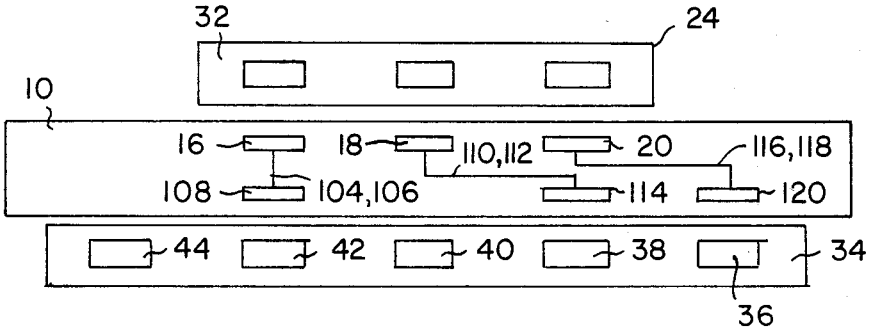

Referring to FIG. 6, contact support member 10 is shown schematically in second operative state. As will be seen, cable 24 is again laterally centered with respect to support member 10, as is cable 34.

The one step transitions are present for the neutral and ground conductors, but support member 10 is now set such that contact element 108 is in registration with conductor 42, the second phase conductor of cable 34. This setting thus provides for interconnection of conductor 26 of cable 24 with conductor 42, and the associated pedestal is powered by the B phase, rather than A phase, as was the case in the FIG. 5 setting.

Figure 7:
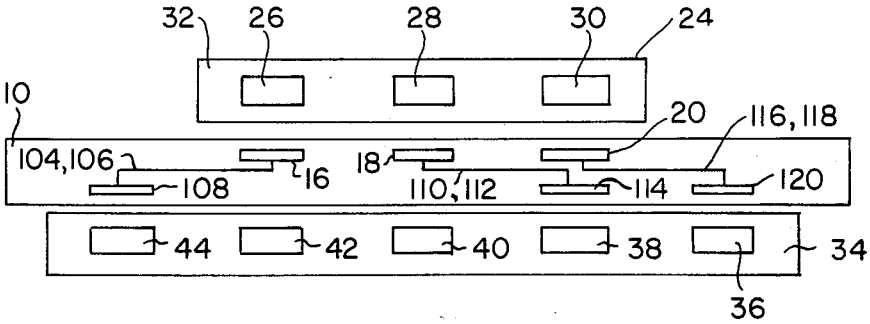

Referring to FIG. 7, contact support member 10 is shown schematically in third operative state. Cable 24 is again laterally centered with respect to support member 10, as is cable 34. The one step transitions are present for the neutral and ground conductors, but support member is now set such that contact element 108 is in registration with conductor 44, the third phase conductor of cable 34. This setting thus provides for interconnection of conductor 26 of cable 24 with conductor 44, and the associated pedestal is powered by the C phase.

As for system installation using the device of the invention, the three conductor cables which are thus connected to the main cable may be routed in any direction as in the case of the '662 application, which is incorporated herein by these references thereto.

By way of summary of the foregoing, the invention will be seen broadly to provide an electrical connection device for use in connecting a first flat conductor cable having a given number of conductors to a second flat conductor cable having conductors in number greater than the given number. In its preferred form, the device comprises contact support means having first and second opposite sides respectively for juxtaposition with the first and second cables and first and second contact element sets having corresponding insulation-piercing contact elements interconnected to one another. The support means retentively supports the first set of contact elements in fixed disposition at the first side thereof for registration with individual conductors of the first cable and retentively supports the second set of contact elements at the second side thereof for selective registration with different groups of conductors of the second cable in the given number.

The support means supports at least one of the contact elements of the second set for movement therein into registration with different conductors of the second cable. For power outlet purposes, a power take-off unit, such as a pedestal, is secured to the support means and is placed in electrical connection with the conductors of the first cable.

Various changes to the illustrated embodiment of the invention may be introduced without departing from the invention. Thus, the particularly discussed and described preferred embodiment is intended in an illustrative and not in a limiting sense. The true spirit and scope of the invention are set forth in the following claims.

We claim:

1. An electrical connection device for use in electrically connecting a first flat conductor cable having a given number of conductors to a second flat conductor cable having conductors in number greater than said give number, said device comprising:

(a) contact support means having first and second opposite side respectively for juxtaposition with said first and second cables; and (b) first and second contact element sets having corresponding insulation-piercing contact elements interconnected to one another, said support means retentively supporting said first set of contact elements in fixed disposition at said first side thereof for registration with individual conductors of said first cable, said support means retentively supporting said second set of contact elements at said second side thereof for selective positioning into registry with individual conductors of said second cable so that by changing such positions of the second contact element set, while the positions of the contact elements of the first set remain fixed, a conductor of the first cable may be joined electrically to different ones of the conductors of the second cable.

2. The invention claimed in claim 1 wherein said support means support at least one of said contact elements of said second set for movement therein into registration with different conductors of said second cable.

3. The invention claimed in claim 1 further including a base for receipt of said support means, said base defining surface cooperative with said support means second side for receipt of said second cable.

4. The invention claimed in claim 3 wherein said support means and said base include respective interfitting recesses and projections effective to limit mutual deflection thereof upon such receipt of said support means by said base.

5. The invention claimed in claim 3 further including a cover for said support means and including openings therethrough, said first contact element set projecting through said cover openings.

6. The invention claimed in claim 5 further including a power take-off unit secured to said cover and said support means and in electrical connection with the conductors of said first cable.

7. The invention claimed in claim 1 wherein said contact support means is a contact support member and defines first and second lateral margins spaced from one another by a measure exceeding the lateral expanse of said second cable, such first contact set being disposed centrally of said contact support member first and second margins.

8. The invention claimed in claim 7 wherein said first cable is a three conductor cable, inclusive of a neutral conductor, a ground conductor and a single phase conductor, and wherein said second cable includes at least four conductors, inclusive of a neutral conductor, a ground conductor and at least two phase conductors, said first cable neutral conductor being in alignment with said second cable ground conductor.

9. The invention claim in claim 7 wherein said first cable is a three conductor cable, inclusive of a neutral conductor, a ground conductor and a single phase conductor, and said second cable is a five conductor cable, inclusive of a neutral conductor, a ground conductor and first, second and third phase conductors, said first cable neutral conductor being in alignment with said second cable ground conductor.

10. The invention claimed in 9 wherein said first and second contact element sets include respective first, second and third pairs of contact elements, the contact elements of said first pair being mutually fixedly disposed and interconnecting said neutral conductors of said first and second cables.

11. The invention claimed in claim 10 wherein the contact elements of said second pair are mutually fixedly disposed and interconnect said ground conductors of said first and second cables.

12. The invention claimed in claim 11 wherein one contact element of said third pair is supported for movement relative to the other third pair contact element into juxtaposition with each of said three phase conductors of said second cable.

13. The invention claimed in claim 11 wherein the contact elements of said third pair interconnect said single phase conductor of said first cable to said first phase conductor of said second cable.

14. The invention claimed in claim 11 wherein the contact elements of said third pair interconnect said single phase conductor of said first cable to said second phase conductor of said second cable.

15. The invention claimed in claim 11 wherein the contact elements of said third pair interconnect said single phase conductor of said first cable to said third phase conductor of said second cable.

16. An electrical connection device for use in connecting conductors of a first flat multiconductor cable to conductors of a second flat multiconductor cable comprising:

an insulative member having first and second opposing surfaces for juxtaposition with said first and second cables; and first and second sets of contact elements supported by said insulative member, said first set of contact elements comprising at least two spaced insulation piercing contact elements disposed in fixed relation to each other at said first surface of said insulative member for registry with individual conductors of said first cable, said second set of contact elements comprising at least two insulation piercing contact elements respectively interconnected to said first set contact elements and movable disposed at said second surface of said insulative member relative to each other for selective registry with conductors greater in number than the number of contact elements of said second set, so that by moving at least one of said insulation piercing contact elements of said second contact element set, while the positions of the contact elements of the first set remain fixed, a conductor of the first cable may be joined electrically to different ones of the conductors of the second cable.

17. An electrical connection device according to claim 16, wherein one of said contact elements of said second set of contact elements is supported on said insulative member in fixed disposition and another contact element of said second set is movable relative thereto for selective registry with plural conductors of said second cable.

18. An electrical connection device for use in connecting conductors of a first flat multiconductor cable to conductors of a second flat multiconductor cable comprising:

an insulative member having first and second opposing surfaces for juxtaposition with said first and second cables; and at least two contact means supported by said insulative member, one contact means comprising a first insulation piercing contact element disposed at said first surface of said insulative member for registry an individual conductor of said first cable and a second insulation piercing contact element disposed at said second surface of said insulative member and fixed relative to said first contact element for registry with an individual conductor of said second cable.

another contact means comprising a third insulation piercing contact element disposed at said first surface of said insulative member for registry with another individual conductor of said first cable and a fourth insulation piercing contact element disposed at said second surface of said insulative member and movable relative to said third contact member for selective positioning into registry with individual conductors of said second cable, so that by changing the position of such fourth insulation piercing contact element, while the position of said third insulation piercing contact element remains fixed, a conductor of the first cable may by joined to different ones of the conductors of the second cable.

19. An electrical connection device according to claim 18, wherein said insulative member is elongate having thereby a longitudinal extend and wherein said fourth contact element is longitudinally alignable and offsettable relative to said third contact element.

20. An electrical connection device according to claim 19, wherein said second contact element is longitudinally offset relative to said first contact element.

21. An electrical connection device for connecting a given number of conductors to flat multiconductor cable having conductors in number greater than said given number, said device comprising:

(a) contact support means having first and second opposite sides respectively for juxtaposition with said given number of conductors and said flat multiconductor cable; and (b) first and second contact element sets interconnected to one another, said second contact element set having insulation piercing contact elements, said support means retentively supporting said first set of contact elements in fixed disposition at said first side thereof for connection with individual conductors of said given number of conductors, said support means retentively supporting said second set of contact elements at said second side thereof for selective positioning into registry with individual conductors of said flat multiconducotr cable so that by changing such positions of the second contact element set, while the positions of the contact elements of the first set remain fixed, a conductor of said given number of conductors may be joined electrically to different ones of the conductors of the flat multiconductor cable.

22. An electrical connection device according to claim 21, wherein said first contact element set comprises insulation-piercing contact elements.

* * * * *